US007230514B2

(12) United States Patent
Brunner

(10) Patent No.: US 7,230,514 B2
(45) Date of Patent: Jun. 12, 2007

(54) INDUCTIVE COMPONENT AND METHOD FOR PRODUCING SAME

(75) Inventor: Markus Brunner, Bessenbach (DE)

(73) Assignee: Vacuumschmelze GmbH & Co KG (DE)

( * ) Notice: Subject to any disclaimer, the term of this patent is extended or adjusted under 35 U.S.C. 154(b) by 417 days.

(21) Appl. No.: 10/250,733

(22) PCT Filed: Nov. 13, 2002

(86) PCT No.: PCT/EP02/12708

§ 371 (c)(1),
(2), (4) Date: Nov. 7, 2003

(87) PCT Pub. No.: WO03/043033

PCT Pub. Date: May 22, 2003

(65) Prior Publication Data

US 2004/0074564 A1 Apr. 22, 2004

(30) Foreign Application Priority Data

Nov. 14, 2001 (DE) ..... 101 55 898

(51) Int. Cl.
*H01F 27/02* (2006.01)
*H01F 27/255* (2006.01)
*H01F 1/14* (2006.01)

(52) U.S. Cl. ..... 336/90; 336/93; 336/96; 336/83; 336/200; 148/100; 148/104

(58) Field of Classification Search ..... None
See application file for complete search history.

(56) References Cited

U.S. PATENT DOCUMENTS

| | | | | |
|---|---|---|---|---|
| 4,474,676 | A | 10/1984 | Ishino et al. | |
| 4,696,725 | A | 9/1987 | Ochiai et al. | |
| 5,372,629 | A * | 12/1994 | Anderson et al. | 75/332 |
| 6,054,210 | A | 4/2000 | Wincheski et al. | |
| 6,063,303 | A | 5/2000 | Ohtaki et al. | |
| 6,328,817 | B1 * | 12/2001 | Murakami | 148/105 |
| 6,814,776 | B2 * | 11/2004 | Kanekiyo et al. | 75/244 |
| 2004/0183643 | A1 * | 9/2004 | Brunner | 336/200 |

FOREIGN PATENT DOCUMENTS

EP 0871183 10/1998

OTHER PUBLICATIONS

Patent Abstracts of Japan, vol. 010, No. 263 (E-435), Sep. 9, 1986.

* cited by examiner

*Primary Examiner*—John P. Sheehan
(74) *Attorney, Agent, or Firm*—Dean W. Russell; Kilpatrick Stockton LLP

(57) ABSTRACT

Inductive component (10; 20; 30) having at least one coil (12; 22; 32) and a magnetically soft core (11; 21; 31) made from a ferromagnetic powder composite in which the ferromagnetic powder composite shows an alloy powder mixture made from alloy powders having formanisotropic as well as formisotropic powder particles and a casting resin.

27 Claims, 1 Drawing Sheet

INDUCTIVE COMPONENT AND METHOD FOR PRODUCING SAME

Figure 1:
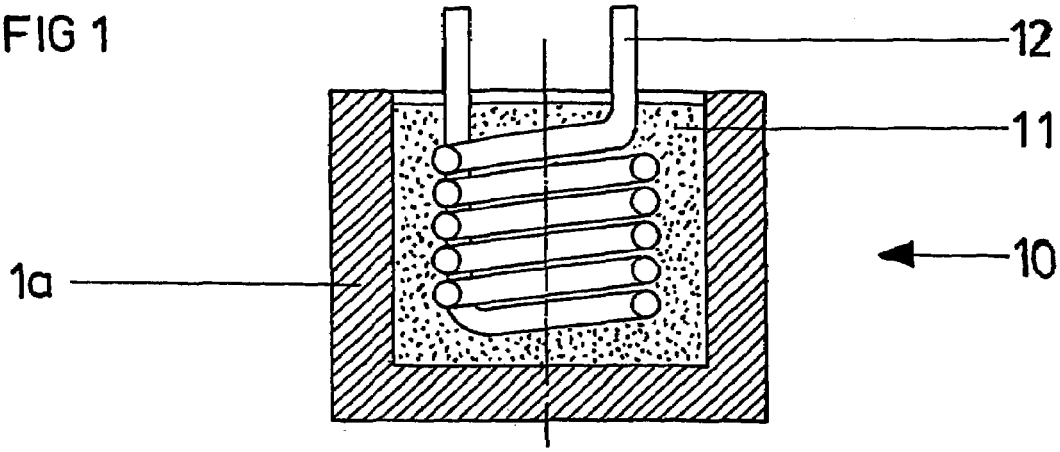

This application claims priority to German Patent Application No. 101 55 898.8 filed on Nov. 14, 2001 and is the U.S. national phase of International Application No. PCT/EP02/12708 filed on Nov. 13, 2002, the entire contents of which are incorporated herein by reference.

The invention pertains to an inductive component having at least one coil and a magnetically soft core consisting of a ferromagnetic powder composite.

Magnetically soft powder components as pressed magnetic cores or as cast or injection-molded magnetic cores have been known for a long time. Suitable alloys for this application are iron powder, iron alloy powder, particularly FeSi or FeAlSi alloys as well as various NiFe alloys.

It is known that in addition to these crystalline alloys Fe- or Co-based amorphous or nanocrystalline alloys were used.

Plastic bonded composites made from magnetically soft materials and thermoplastic or thermosetting materials, which can be processed as a workpiece, injection molding part or as unpressurized casting are known for instance from JP 321934, JP 321935, JP 321936, JP 321933, JP 137431 or JP 00590501. The use of formanisotropic magnetic particles and the production of connection parts having an increased permeability from these particles, while the particles are aligned by means of pressure, directional flow as well as external magnetic fields, have been described for instance in JP 240635, JP 55061706, JP 181177, JP 11240635, JP 06309059 or JP 10092585.

The use of magnetic powders in combination with finest ceramic particles as insulating spacers has been disclosed in JP 241658. The use of magnetic powders of clearly different particle sizes (2–3 fractions) for optimizing the packing density for unpressurized casting can be learned from JP 11101906, JP 242400 or JP 11218256. It is known from DE 333 4827 or DE 245 2252 to recast a coil using a compound which contains a magnetically soft material. JP 05022393 finally teaches the use of alloy powders of different ductilities in order to optimize the compressed densities.

It is desirable for the use as a restrictor material to produce magnetic cores with a high permeability ($\mu$>40) and a DC pre-stress capacity ($B_o$>0.2 T). The DC pre-stress capacity is a measure for the energy, which is stored in the magnetic material (see R. Boll for a definition of DC pre-stress capacity: "Magnetically soft materials", Siemens A G, 1990, pg.114 f).

The customary production method consists in pressing cores into appropriate tools while using for instance a toroidal core or e-core form. Pressure within the range of 5–15 t/cm$^2$ will be required in order to pack the magnetic powder alloys. A heat treatment using temperature above 500° C. will be necessary for most alloys in order to restore the proper magnetically soft characteristics subsequent to the shaping. Both of these steps, shaping under high pressures and the subsequent heat treatment, are rendering it practically impossible to produce components with a coil in this manner, which would be enveloped in a magnetic material.

Only a casting or injection molding process is practically suitable for the manufacture of such components. However, only comparatively low packing densities within the range of a maximum of 70 percent by volume of magnetic material can be obtained using this method. Related thereto are the typical permeabilities of the material within the range around approx. 10–20. In order to increase the permeability here it is possible to achieve an increased packing density and thus a decrease of the effective air gap between the individual particles by means of powder mixtures having powder particles of various diameters. However, only permeabilities up to approx. 40 can be achieved in this manner.

An additional possibility consists in the use of formanisotropic particles and a subsequent alignment in the magnetic field where the effective air gap between the individual particles can be partially compensated by means of the particle's large overlapping.

Yet this final alternative is narrowly confined as well, as on the one hand, the mixture's fluidity must be ensured, and, on the other hand, the alignment of the formanisotropic particles in the magnetic field cannot be created in an effective manner. The force effect, which can be obtained by means of an external magnetic field on the particles, is very limited since only the particles' formanisotropy can be used for the alignment.

This alignment is by far not as effective as for instance the alignment, which is possible via the crystalline isotropy of the magnetic powder particles. The consequence of this is that an alignment of formanisotropic particles by means of magnetic fields in highly viscous injection molding materials becomes practically impossible, and that only a moderate alignment of the powder particles can be obtained in casting slips having comparatively low viscous cast resins. Thus, these formanisotropic particles are virtually statically distributed over the largest part of the component volume even after the alignment by means of the magnetic fields, and it cannot be avoided that a noticeable part of the magnetic powder particles be placed parallel to the direction of the direction of magnetizing in the component with its line of action, and that it practically no longer contributes to the magnetizing within the component.

This loss of magnetizable material can be noticed in particular in the obtained saturation induction or pre-stress capacity of the static magnetic field when using formanisotropic particles in magnetic powder mixtures. It is true that comparatively high permeabilities up to a range of several hundred can be obtained, but the pre-stress-capacity of the static magnetic field continues to remain very limited (typically <0.2 T).

The invention's task thus consists in specifying an inductive component as well as a method for its production, which would allow for a wrapping of prefabricated coils using a magnetically soft material whereby this material allows comparatively high permeabilities ($\mu$>40) or a high pre-stress-capacity of the static magnetic field ($B_o$>0.3 T).

The invention's advantage consists in that inductive components can be created having a universal shaping and a high packing density with a high permeability ($\mu$>40) and a high static magnetic field pre-stress capacity ($B_o$>0.3 T).

This will be achieved in particular through an inductive component of the type, which was initially mentioned, by means of the ferromagnetic powder compound material showing an alloy powder mixture consisting of an alloy powder having formanistotropic as well as an alloy powder having formisotropic powder particles and a casting resin.

It is preferred that the alloy powder mixture features a coercive field strength, which is less than 150 mA/cm, a saturation magnetostriction and a crystalline anisotropy of approximately zero, a saturation induction of >0.7 T as well as a specific electric resistance of greater than 0.4 ohm*mm$^2$/m. The formanisotropic powder particles can comprise flakes consisting of amorphous or nanocrystalline alloys as well as elliptic parts consisting of crystalline alloys having an aspect ratio that exceeds 1.5. It is preferred that the formanisotropic powder particles have a particle diameter of 30–200 μm. In addition thereto, the formanisotropic as well as the formisotropic powder particles can be surface-insulated. The surface insulation can for instance be created by means of oxidation and/or a treatment using phosphoric acid.

In a continued development of the invention it has been provided that the alloy powder mixture shows two formisotropic alloy powders in addition to the anisotropic alloy powder, of which one alloy powder shows coarse particles with a particle diameter of 30–200 μm and the other alloy powder shows fine particles having a particle diameter of under 10 μm. That the ratio of alloy powder having formanisotropic particles is 5–65 percent by volume, the alloy powder having coarse formisotropic particles is 5–65 percent by volume and the alloy powder having fine formisotropic particles is 25–30 percent by volume of the alloy powder mixture.

The formisotropic powder particles can contain carbonyl iron. The formanisotropic powder particles can contain FeSi alloys and/or FeAlSi alloys and/or FaNi alloys and/or amorphous or nanocrystalline Fe- or Co-based alloys.

It is preferred that the casting resin features a viscosity that is less than 60 mPas in its uncured condition as well as a permanent inflection temperature exceeding 150° C. in its cured condition. For casting resins a resin from an expoxide group, epoxidated polyurethane, polyamides as well as methacrylate esters can be used.

The ratio of the alloy powder mixture is preferably at 70–75 percent by volume, the ratio of the casting resin is at 25–30 percent by volume. The powder composite can also contain an admixture of flow additives such as for instance additives, which are based on silicic acid.

Finally, the inductive component can also feature a case.

The method in accordance with the invention for producing an inductive component having at least one coil and a magnetically soft core consisting of a ferromagnetic powder composite is characterized by the following steps in its first embodiment:

a) provision of a form, an alloy powder mixture and a casting resin formulation:
b) filling of a form with an alloy powder mixture;
c) filling of casting resin formulation into the form; and
d) curing of the casting resin formulation.

In an alternative embodiment of the present invention the method for producing an inductive component with at least one coil and a magnetically soft core consisting of a ferromagnetic powder composite is characterized by the following steps:

a) provision of a form, an alloy powder mixture and a casting resin formulation:
b) blending of the alloy powder mixture and the casting resin formulation into a casting resin powder formulation;
c) filling of the casting resin powder formulation into the form; and
d) curing the casting resin powder formulation.

Contrary to the injection molding method, this method will avoid that the powder particles are exposed to a mechanical stress during the manufacturing process. Furthermore, particularly when using a form, which is equipped with pre-fabricated coils, the insulation layer that is applied to the coil's filaments will not be damaged, since the filling in into the form of a casting resin formulation or casting resin powder formulation, which is as low as possible, does not damage the form due to a gentle discharging of the formulations. It is particularly preferred to use casting resin formulations having viscosities of several few milli pascal seconds.

In another embodiment of the present invention, and in particular when obtaining larger filling levels in the form, it has been proven to be advantageous to mix the alloy powder mixture with the casting resin formulation before filling the form. In this embodiment of the invention one can work with a small amount of excessive casting resin, which promotes the flow capacity of the then produced casting resin powder formulation. While the form is being filled it will be oscillated for instance by means of a compressed air vibrator, which leads to the casting resin powder formulation being properly mixed. The casting resin formulation is degassed at the same time.

The alloy powder breaks away without any problems as the alloy powder has a very high density as compared with the casting resin, so that the used excess casting resin can for instance be collected in a sprue bush, which can be removed after the powder composite has been cured.

Inductive components can be produced in one production step by using forms, which are already equipped with pre-fabricated coils, so that the work-intensive 'winding-on' or application of pre-fabricated coils onto partial cores and the assembly of the partial cores to create complete cores would not be required afterwards.

The form, which is filled with the alloy powder and the casting resin formulation, and which has already been filled with a ready-made casting resin is used 'in a continued manner' as a case of the inductive component in a preferred embodiment of the invention. This means that the form serves as a "lost casing" in this embodiment of the present invention. This approach provides for a particularly effective and cost-efficient method, which includes considerable simplifications particularly in contrast to the injection molding method. The initially mentioned injection molding method always requires a form, of which the production is very complex and expensive, and which can never serve as "lost casing".

During the injection molding procedure the produced component or the produced magnetically soft core consisting of powder composite will always have to be removed from the form, which is an elaborate process, and which leads to longer production times.

Polymer components, which have been blended with a polymerization initiator (starter), are typically used as casting resin formulations. The polymer components methacrylic acid methyl esters are particularly suitable. However, other polymer components such as lactame are also possible. The methacrylic acid methyl esters will be polymerized to an acrylic during the curing process. The lactame will be analogously polymerized into polyamides via a poly addition reaction.

Dibenzoyl peroxide or for instance 2.2' azo isobutyric acid dinitril are suitable as polymerization initiators.

However, other polymerization processes of the known casting resins are possible as well, as for instance polymerizations, which are triggered via light or UV radiation, which in other words means that they can largely do without polymerization initiators.

The powder particles are aligned during and/or after filling the form with the alloy powder mixture by means of creating a magnetic field in a particularly preferred embodiment of the invention. This can occur particularly when using forms, which have already been equipped with coils, by means of passing a current through the coil and the accompanying magnetic field. The powder particles are aligned by means of the creation of magnetic fields, which purposefully have a strength exceeding 10 A/cm.

It is particularly advantageous to align the powder particles, which are formanisotropic, along the magnetic field's lines, which exist in the inductive component, and which will be operated at a later time. A considerable decrease of the loss and an increase of the permeability of the magnetically soft cores and thus of the inductivity of the inductive component can be achieved by aligning the powder particles using their "long" axis parallel to the magnetic field lines.

In order to obtain higher permeabilities of the magnetically soft core, it is advantageous to create a magnetic field, which will act as an orientation of the formanisotropic powder particles in the direction of the magnetic flow, by means of the coil, which is lying in the form, when filling in the casting resin powder formulation, should a casting resin powder formulation be used. The form will initially be vibrated after it is completely filled, which in turn can take place by using the compressed air vibrator, and the magnetization flow will subsequently be turned off. The resulting inductive component will be removed from the mold after the final curing of the casting resin formulation.

A compaction or sedimentation of the alloy powder mixture finally takes place by means of shaking during and/or after the filling of the form using the alloy powder mixture, casting resin formulation or casting powder formulation.

Various combinations of different procedures are particularly advantageous, although the individual methods are already significantly improving the characteristics of inductive components of the type, which had been mentioned initially. Thus, the obtainable permeability or the obtainable pre-stress capacity of the static magnetic field can be controlled by the mixing ratio, which can be selected, between the isotropic and anisotropic portion. Flakes consisting of amorphous, nanocrystalline or crystalline alloys as well as elliptic particles, whose aspect ratios are greater than 1.5, which can for instance be produced by appropriately matched gas pulverization processes, can be used as formaninsotropic powder particles. Carbonyl iron powders lend themselves to be used as an isotropic mixture component for instance. These powders are preferably surface-insulated so that in addition to the direction of the flow—by means of the fine magnetic powder particles—an additionally insulating effect takes place in the powder mixture. These fine powder particles act as electrically insulating spacers between the larger formanisotropic powder particles in the mixture.

The use of ternary magnetic powder mixtures achieves still better characteristics than the use of these binary metal powder mixtures. For this purpose a combination consisting preferably on the one hand of coarser formanisotropic powder particles having dimensions within the range between 30–200 μm, and preferably 50–200 μm in the lateral extension and an aspect ratio of greater than 1.5, and on the other hand, a second isotropic powder component having a particle diameter within the range of 30–200 μm and having a spheric particle diameter within a range below 10 μm are used. The latter powder component preferably consists of surface-insulated carbonyl iron powder.

In addition, the ternary mixture consisting of coarser spheric powder particles features a significantly improved flow capacity of the casting slip than the previously described binary powder mixture consisting of flakes and fine powder. In addition, the powder particles' movement within the magnetic field is markedly facilitated due to the increased portion of coarser spheric particles. A very large alloy spectrum can be used with respect to the coarser particles of the formisotropic as well as of the formanisotropic powder particles. The basic requirement for a utilization of this powder mixture is an alloy having a coercive field strength, which is as low as possible, imperceptible saturation magnetostriction and crystal anisotropy as well as a specific electrical resistance, which is as high as possible. These requirements are met for instance by FeSi alloys, FeAlSi alloy powders, FeNi alloy powders as well as amorphous and nanocrystalline Fe- or Co-based alloy powders. Furthermore, it is important that all required heat treatment steps are completed before the casting core's production. This is also the case with the mentioned alloys.

For instance a magnetic powder mixture consisting of a combination of 5–65 percent by volume of formanisotropic powder particles having an aspect ratio exceeding 1.5 and a particle size exceeding 30 μm as the first component as well as a coarser isotropic powder component having particle diameters larger than 30 μm and a ratio of 5–65 percent by volume as a second component as well as the carbonyl iron powder having a volume content of 25–30 percent by volume as a third component can be used to produce the components in accordance with the invention. A homogenous mixture is created using the cited individual components in a suitable mixer. The addition of flow additives, which are based on silicic acid, to this powder mixture has proven itself as it avoids an aggregation of the fine powder parts. A mixing of the thus prepared magnetic powder mixture using the resin mixture provided for the casting will subsequently take place.

The selection of the usable resins goes by the characteristics in the cured and uncured condition. Resins having viscosities, which are smaller than 50 mPas in their uncured condition, and permanent inflection temperature above 150° C. can be used. These characteristics are met for instance by resins from the epoxide group, of the epoxidized polyurethanes as well as by the various methacrylate esters.

The production of a mixture that can be cast subsequently takes place by mixing 70–75 percent by volume of a magnetic powder mixture and 25–30 percent by volume of a selected resin. This mixture will be degassed while being stirred in a vacuum, and subsequently filled in the provided potting form. A compaction or sedimentation of the magnetic powder takes place in the form by means of a mechanic shaking and concurrently an alignment of the formanisotropic portion of the magnetic powder by means of an external magnetic field or providing an electrical current to the inserted copper coil. The resin is cured at an increased temperature following the alignment of the formanisotropic powder portion.

The production of casting cores within the permeability range between approx. 20 and 100 is easily possible using the described technology. The attainable permeability will be determined by means of the formanisotropic particles' size and their percent by volume in the total powder mixture. Values around 0.3 and 0.35 T are reached with respect to the pre-stress capacity of the static magnetic field. The magnetic reversal losses of components, which were produced in such manner, are approximately ranging on the same level as permeability-identical ring cores from FeAlSi or NiFe alloys, which contain large amounts of nickel.

Figure 2:
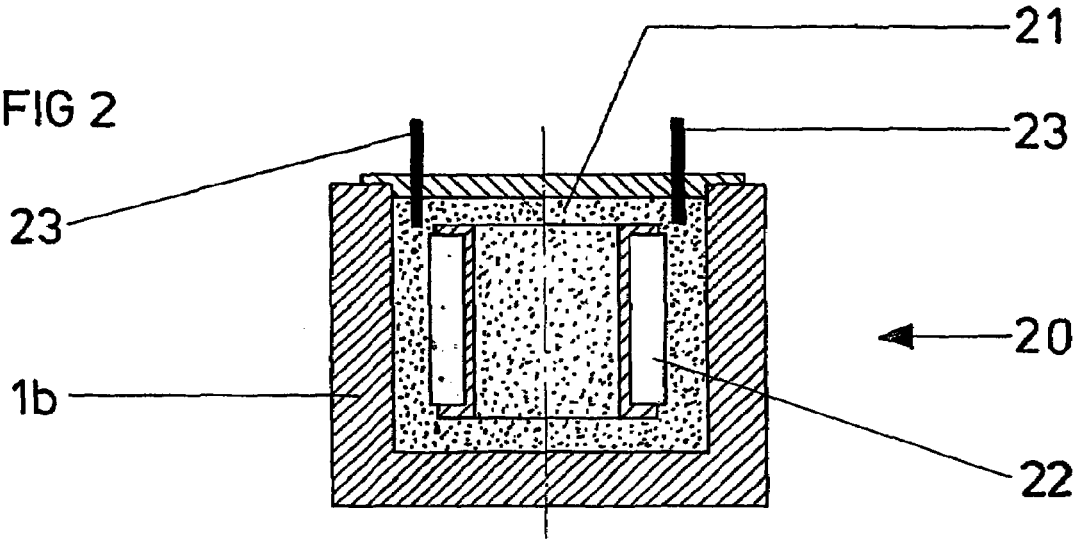
Figure 3:
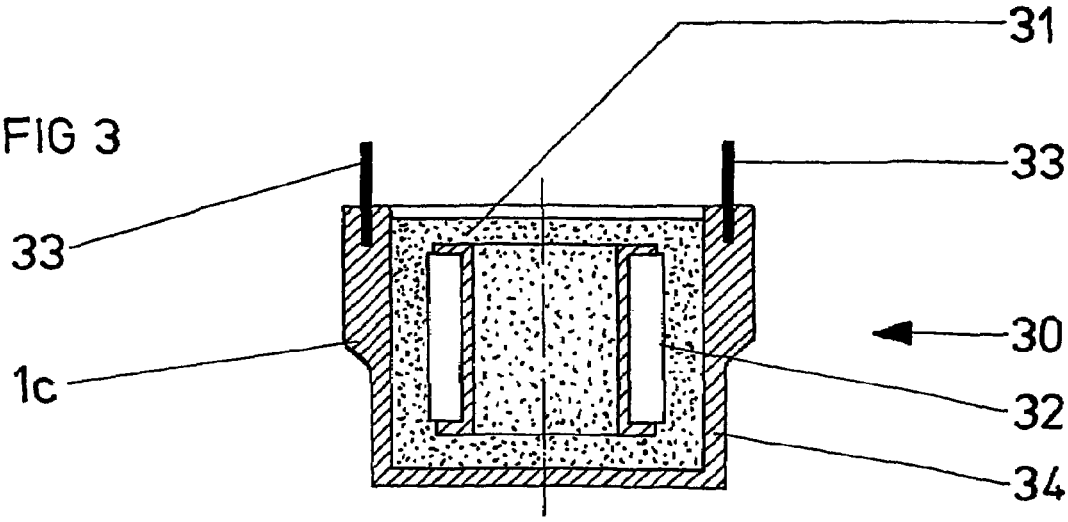

The invention will subsequently be described in more detail by means of the embodiment forms, which are illustrated in the figures of the drawing. The following is shown:

FIG. 1 a cross-section of an inductive component in accordance with the first embodiment of the present invention;

FIG. 2 a cross-section of an inductive component in accordance with the second embodiment of the invention:

FIG. 3 a cross-section of an inductive component in accordance with a third embodiment of the present intention.

FIG. 1 depicts inductive component 10. Inductive component 10 consists of magnetically soft core 11 and coil 12 consisting of a relatively thick copper wire with only a few coils. The coils can consist of round wire as well as of flat wire having one or more layers. The wire's copper diameter can be increased, which in turn leads to a reduction of the resistive losses in the coil particularly due to the use of flat copper wire due to the more compact coil assembly at a constant component volume. The component volume can be reduced accordingly in case of a constant coil resistance by means of this measure. FIG. 1 shows component 10 during its production. Component 10 is brought into a form 1*a*, which consists of aluminum in this case.

Likewise, FIG. 2 shows an inductive component 20, which consists of a magnetically soft core consisting of powder compound composite 21, in which layer coil reel 22 was built in. Layer coil reel 22 is connected at its coil ends by means of pins 23, which protrude from magnetically soft core 21, and which serve for a connection to a base plate, for instance a conductor board. As in FIG. 1, inductive component 20 in FIG. 2 is shown during its production. This means that inductive component 20 is shown here in form 1*b*, into which the powder composite is cast.

FIG. 3 also shows an inductive component as in FIGS. 1 and 2. Inductive component 30 shown here consists of magnetically soft core 31, a powder compound into which in return reel 32 was built in. Layer coil reel 32 is connected to connector pins 33 at its coil ends, which protrude from form 1*c*, which concurrently serve as case 34.

One of the following powder mixtures has been provided as the base material for the powder composite:

Sample Formulation 1: Casting Cores Having a Low Permeability

The following formulation can be used for instance for the production of a casting core in a permeability range between 35–40 and a component weight of approx. 100 g:

- 72 g preliminary annealed and surface-insulated powder made from $Fe_{84}Al_6Si_{10}$ or $Ni_{78}Fe_{18}$ having a median particle diameter of approx. 50 μm and a spheric form
- 21 g phosphated carbonyl iron
- 9 g casting resin mixture Casting cores having a permeability of approx. 40, a static magnetic field pre-stress capacity of approx. 0.35 T and magnetic reversal losses of approx. 90–110 W/kg at 100 KHz and alternate level controls of 0.1 T can be produced from the above mixture.

Sample Formulation 2: Casting Cores Having a Median Permeability.

The following formulation can be used for instance for the production of a casting core within a permeability range of approx. 60 and a component weight of approx. 100 g:

- 16 g preliminary annealed and surface-insulated powder made from $Fe_{84}Al_6Si_{10}$ or $Ni_{78}Fe_{18}$ or $Fe_{73,5}Cu_1Nb_3Si_{15,5}B_7$ having a median particle diameter of approx. 40–200 μm and an aspect ratio of >1.5.
- 48 g preliminary annealed and surface-insulated powder made from $Fe_{84}Al_6Si_{10}$ or $Ni_{78}Fe_{18}$ having a median particle diameter of approx. 50 μm and a spheric form.
- 21 g phosphated carbonyl iron
- 9 g casting resin mixture Casting cores having a permeability of approx. 65, a static magnetic field pre-stress capacity of approx. 0.30 T and magnetic reversal losses of approx. 90–110 W/kg at 100 KHz and alternate level controls of 0.1 T can be produced from the above mixture.

Sample Formulation 3: Casting Cores Having a Higher Permeability.

- 48 g preliminary annealed and surface-insulated powder made from $Fe_{84}Al_6Si_{10}$, $Ni_{78}Fe_{18}$ or $Fe_{73,5}Cu_1Nb_3Si_{15,5}B_7$ having a median particle diameter of approx. 40–200 μm and an aspect ratio of >1.5.
- 16 g preliminary annealed and surface-insulated powder made from $Fe_{84}Al_6Si_{10}$ or $Ni_{78}Fe_{18}$ having a median particle diameter of approx. 50 μm and a spheric form.
- 21 g phosphated carbonyl iron
- 9 g casting iron mixture Casting cores having a permeability of approx. 85, a static magnetic field pre-stress capacity of approx. 0.27 T and magnetic reversal losses of approx. 90–110 W/kg at 100 KHz and alternate level controls of 0.1 T can be produced from the above mixture.

It is annotated that the aforementioned alloy powder mixture only serves as an example. An abundance of other alloy powder mixtures is possible in addition to the above shown formulations.

As can be seen, the formanisotropic powder particles, which are also called flakes due to their shape, were subjected to a heat and surface treatment in order to improve their dynamic characteristics. In addition, the formisotropic powder particles were treated using phosphoric acid for isolating purposes, whereby an electrically insulating iron phosphate is formed at its surface.

In the embodiments shown in FIGS. 1 and 2 the alloy powder mixtures thus prepared were filled into forms 1*a* or 1*b*, respectively. The forms 1*a* or 1*b* respectively, which consisted of aluminum, showed a suitable separation coating at their internal walls so that a more complicated removal from the mold of the inductive components 10 or 20 could not occur. Thus, electrical currents were passed through coils 12 or 22 so that the powder particles were aligned with their "long axis" parallel to the magnetic field thus being created, which was approx. 12 A/cm.

Subsequently a casting resin formulation was filled into the forms, respectively, into which the alloy powder was filled, which are depicted in the embodiments shown in FIGS. 1 and 2.

A thermoplastic methacrylate formulation was filled in the embodiment shown in FIG. 1. The thermoplastic methacrylate formulation was composed as follows:

- 100 g Methacrylic acid methyl ester
- 2 g Methacrylic trimethoxysilane
- 6 g Dibenzoyl peroxide and
- 4.5 g N,N-Dimethyl-p-toluidine A thermoplastic methacrulate formulation was also filled in the embodiment shown in FIG. 2 whereby this methacrylate formulation was composed as follows:

- 100 g Methacrylic acid methyl ester
- 2 g Methacrylic trimethoxysilane
- 10 g Diglycoldimenthacrylate
- 6 g Dibenzoyl peroxide and
- 4.5 g N,N-Dimenthyl-p-toluidine In both embodiments the aforementioned chemical components were dissolved successively in methacrylic ester. The final mixture was clear like water in both cases and was poured in forms 1*a* and 1*b*. The casting resin formulations cured in both cases at room temperature within approx. 60 minutes. A subsequent post-curing took place at approx. 150° C. for another hour.

It proved to be appropriate when filling forms 1*a* or 1*b* with the alloy powder mixture to vibrate forms 1*a* or 1*b* during the filling process in order to thus compress the alloy powder mixture. Using this proceeding, a volume share of up to 70 percent by volume of the alloy powder mixture could be obtained in the powder composite in both cases without any problems.

A warm curing thermoplastic methacrylate formulation was used in the embodiment depicted in FIG. 3, which was composed as follows:

100 g Methacrylic acid methyl ester 0.1 g 2.2' azo isobutyric acid

This casting resin formulation was filled into form 1*c* as shown in FIG. 3 and cured within 15 hours at a temperature of approx. 50° C. It proved to be particularly beneficial to use a warm curing casting resin formulation as this provided for a particularly intensive and good contact between form 1*c* consisting of plastic, and the powder composite since form 1*c* in FIG. 3 was used as "lost casing", which means that is was used as case 34 for the inductive component after the production process.

This casting resin formulation was also subsequently post-cured at approx. 150° C. for approx. one hour.

It is annotated that the aforementioned casting resin formulations only serve as examples. An abundance of other casting resin formulations are possible, which are chemically netted in different manner than was the case in the above shown formulations.

For the sake of completeness it is noted that the above-cited formulations were polymerized and dibenzoyl peroxide or 2.2' azo isobutyric acid dinitril were used as starter substances. However, it is particularly possible to make do without a special starter substance and to polymerize monomer components, i.e. chemical agents as the methacrylic acid methyl esters in this case using UV light. The viscosity or the impact-strength of the created powder composite can be adjusted and increased in particular by mixing in methacrylic methoxisilane or diglycoldimethacrylate and other chemical substances.

Melts particularly from E-caprolactam and phenyliso cyanate can be used in particular when using thermoplastic polyamides; thus a melt consisting of 100 g E-caprolactam and 0.4 g phenyliso cyanate, which were mixed together at 130° C. has been proven as suitable.

This melt was filled into a form, which was preheated to 150° C. The curing of caprolactamus to a polyamide took approx. 20 minutes. A post-curing at higher temperatures was generally not necessary with this type of procedure.

Naturally another lactam, for instance laurin lactam, can be used with an appropriate binder phase. However, process temperatures exceeding 170° C. will be required for processing laurin lactam.

Of course the use of reaction resins, which provide thermosetting molding materials is possible in addition to the so far described thermoplastic binder resin formulations. The use of two-component warm curing epoxy resins is possible in this case. A casting resin from this group would be composed as follows for instance:

100 g Cycloaliphatic epoxy resin having a molecular weight of <700 g/mol, an epoxy content of 5.7–6.5 equiv./kg and a viscosity of <800 mPas 100 g Acid hydride hardener having a molecular weight of <700 g/mol, a hydrogen equivalent weight between 145 and 165 and a viscosity <100 mPas 2.5 g Catalyst (amine based)

The sealing resin is produced from the aforementioned individual components by mixing them at room temperature. The mixture is heated to temperatures around 80+/−10° C. for processing purposes. This will decrease the mixtures' viscosity to <20 mPas. To cure the components, which were produced from this mixture, a heating to temperatures of approx. 150° C. for a duration of approx. 30 minutes takes place.

Inductive components having magnetically soft cores made from ferro-magnetic powder composites were made using the aforementioned casting resin formulations, which show magnetic reversal losses, such as permeability similar toroidal cores consisting of FeAlSi or NiFe alloys, which contain high amounts of nickel. The achievable permeability of approx. 20 and 100 will be determined by the size of the formanisotropic particles and their volume content in the total powder mixture. Values between 0.3 and 0.35 T are obtained with respect to the pre-stress capacity of the static magnetic field.

The invention claimed is:

1. Inductive component having at least one coil and a magnetically soft core made from a ferromagnetic powder composite, the ferromagnetic powder composite comprising an alloy powder mixture made from alloy powders having formanisotropic powder particles with aspect ratios exceeding 1.5 as well as formisotropic powder particles and a casting resin.

2. Inductive component in accordance with claim 1 in which the alloy powder mixture has a coercive field strength which is less than 150 mA/cm, a saturation magnetostriction and a crystalline anisotropy of approximately zero, a saturation induction of >0.7 T as well as a specific electric resistance of greater than 0.4 Ohm*mm$^2$/m.

3. Inductive component in accordance with claim 1 in which the formanisotropic powder particles includes amorphous, nanocrystalline or crystalline alloys.

4. Inductive component in accordance with claim 1 in which the formanisotropic powder particles have an elliptic form.

5. Inductive component in accordance with claim 1 in which the formanisotropic powder particles have a particle diameter of 30 to 200 μm.

6. Inductive component in accordance with claim 1 in which the formanisotropic powder particles are surface insulated.

7. Inductive component in accordance with claim 1 in which the alloy powder mixture comprises two formisotropic alloy powders of which one alloy powder comprises coarse particles having a particle diameter of 30 to 200 m and the other alloy powder comprises particles having a particle diameter below 10 μm.

8. Inductive component in accordance with claim 7 in which the portion of the alloy powder with formanisotropic particles is 5 to 65 percent by volume, of the alloy powder with coarse particles is 5 to 65 percent by volume, and of the alloy powder with fine formisotropic particles is 25 to 30 percent by volume of the alloy powder mixture.

9. Inductive component in accordance with claim 1 in which the form isotropic powder particles contain carbonyl iron.

10. Inductive component in accordance with claim 1 in which the formanisotropic powder particles contain FeSi alloys andlor FeAlSi alloys and/or FeNi alloys and/or amorphous or nanocrystalline Fe- or Co-based alloys.

11. Inductive component in accordance with claim 1 in which the casting resin has a viscosity of lesser than 50 mPas in its uncured condition and a permanent inflection temperature exceeding 150° C. in its cured condition.

12. Inductive component in accordance with claim 11 in which at least a resin from the expoxide group, of the epoxidized polyurethane as well as of the methylacrylate esters is provided as the casting resin.

13. Inductive component in accordance with claim 1 in which the portion of the alloy powder mixture is 70 to 75 percent by volume and the portion of the casting resin is 25 to 30 percent by volume of the powder composite.

14. Inductive component in accordance with claim 1 in which the powder composite contains a flow additive.

15. Inductive component in accordance with claim 1 in which the inductive component shewscomprises a case.

16. Method for the production of an inductive component in accordance with claim 1 comprising the following steps:

a) provision of a form being equipped with at least one pre-fabricated coil, an alloy powder mixture and a casting resin formulation;

b) filling the form with the alloy powder mixture;

c) filling the casting resin formulation into the form; and d) curing the casting resin formulation.

17. Method for the production of an inductive component in accordance with claim 1 comprising the following steps:

a) provision of a form being equipped with at least one pre-fabricated coil, an alloy powder mixture and a casting resin formulation;

b) mixing of the alloy powder mixture and the casting resin formulation into a casting resin formulation;

c) filling the casting resin powder formulation into the form; and d) curing of the casting resin formulation.

18. Method in accordance with claim 16 comprising at least one form being provided, which is equipped with at least one coil comprising round wire or shaped wire and having an insulating layer.

19. Method in accordance with claim 16 in which the form is used as a case of inductive component.

20. Method in accordance with claim 16 in which a casting resin formulation comprising polymer components and a polymerization initiator is used.

21. Method in accordance with claim 20 in which methacrylic acid methyl ester is used as a polymer component.

22. Method in accordance with claim 21 in which dibenzoyl peroxide is used as a polymerization initiator.

23. Method in accordance with claim 21 in which 2.2' azo isobutyric acid dinitril is used as a polymerization initiator.

24. Method in accordance with claim 16 comprising the powder particles being aligned during andlor after filling the form with the alloy powder by means of creating a magnetic field.

25. Method in accordance with claim 24 in which the magnetic field is created by means of providing an electric current to the coil.

26. Method in accordance with claim 24 in which a magnetic field is created with a field strength greater than 10 A/cm.

27. Method in accordance with claim 16 comprising a compaction or sedimentation of the alloy powder mixture taking place by means of shaking after the filling of the form with the alloy powder mixture, casting resin formulation or casting powder formulation.

* * * * *